US008027619B2

(12) United States Patent
Murata et al.

(10) Patent No.: US 8,027,619 B2
(45) Date of Patent: Sep. 27, 2011

(54) TONER CONTAINER HAVING A TONER AGITATING FUNCTION UNIT WITH A TUBULAR MEMBER HAVING AXIALLY SPACED RING PIECES AND OPENINGS BETWEEN THE RING PIECES

(75) Inventors: Koji Murata, Osaka (JP); Chisato Hatakeyama, Osaka (JP)

(73) Assignee: Kyocera Mita Corporation (JP)

( * ) Notice: Subject to any disclaimer, the term of this patent is extended or adjusted under 35 U.S.C. 154(b) by 534 days.

(21) Appl. No.: 12/203,943

(22) Filed: Sep. 4, 2008

(65) Prior Publication Data

US 2009/0067888 A1 Mar. 12, 2009

(30) Foreign Application Priority Data

Sep. 6, 2007 (JP) ..... 2007-231855

(51) Int. Cl.
*G03G 15/06* (2006.01)

(52) U.S. Cl. ..... 399/254; 399/263

(58) Field of Classification Search ..... 399/254, 399/258, 263

See application file for complete search history.

(56) References Cited

U.S. PATENT DOCUMENTS

| | | | | |
|---|---|---|---|---|
| 5,189,474 | A | 2/1993 | Miya et al. | |
| 5,682,584 | A * | 10/1997 | Hattori et al. | 399/263 |
| 5,918,095 | A | 6/1999 | Huang | |
| 7,248,823 | B2 * | 7/2007 | Buhay-Kettelkamp et al. | 399/254 |
| 7,672,623 | B2 * | 3/2010 | Stelter et al. | 399/258 |
| 7,817,943 | B2 * | 10/2010 | Utsumi et al. | 399/254 |
| 2004/0062574 | A1 | 4/2004 | Isomura et al. | |
| 2006/0188273 | A1 | 8/2006 | Takesawa et al. | |

FOREIGN PATENT DOCUMENTS

| | | |
|---|---|---|
| CN | 1722017 | 1/2006 |
| JP | 9-265229 | 10/1997 |

* cited by examiner

*Primary Examiner* — William J Royer
(74) *Attorney, Agent, or Firm* — Gerald E. Hespos; Michael J. Porco

(57) ABSTRACT

A toner container is mounted to an image forming apparatus in a state of containing toners. The toner container includes: a container body for containing toners; and an agitating unit provided in the container body for agitating the toners. The agitating unit includes: a cylindrical member having a cylindrical peripheral wall and rotating about an axis of cylinder; an opening formed in the cylindrical peripheral wall for allowing the toners to pass through; and a conveying section for conveying the toners in a direction of the axis of the cylindrical member.

11 Claims, 8 Drawing Sheets

TONER CONTAINER HAVING A TONER AGITATING FUNCTION UNIT WITH A TUBULAR MEMBER HAVING AXIALLY SPACED RING PIECES AND OPENINGS BETWEEN THE RING PIECES

BACKGROUND OF THE INVENTION

1. Field of the Invention

The present invention relates to a toner container which is mounted to an image forming apparatus in a state of containing toners.

2. Description of the Related Art

Conventionally, there has been a known toner container for supplying toners to a developing device which is provided in an image forming apparatus such as a printer and a copying machine. Such toner container is dismountably mounted to an image forming apparatus. If the amount of toners in the container runs short, a user dismounts the container from the image forming apparatus, and mounts a new container containing sufficient amount of toners. Accordingly, toners can be supplied continuously to the developing device.

Meanwhile, if a toner container in a state of containing toners is left for a long time, toners in the container are compressed by their weight and hardened (solidified). Especially, in a state where the toner container stands, toners in the container move to one side. If the container is vibrated in this state, toners are hardened so strongly. Therefore, there has been a known toner container provided with an agitating member which rotationally drives about an axis. The agitating member has a configuration in which an agitating portion for agitating toners projects radially outward from an outer peripheral surface of a rotational shaft. This agitating portion moves toward a circumferential direction about the rotational shaft, so that the solidified toners are unsolidified and stirred.

Further, Japanese Patent Unexamined Publication No. H09-265229 discloses a toner cartridge which is so configured that if an excessive load is applied to an agitating member at a time when the agitating member is started up, transmission of a drive force to the agitating member is shut down so that the agitating member is protected.

However, since the agitating section moves in the circumferential direction while breaking down the solidified toner at a time of starting up the agitating member, a great amount of load is applied to the agitating section or the rotational shaft. Accordingly, there is a problem that a torque necessary for starting the agitating operation becomes large.

SUMMARY OF THE INVENTION

An object of the present invention is to provide a toner container which is capable of starting an agitating operation at a low torque and efficiently agitating toners during the operation.

A toner container in accordance with an aspect of the present invention which achieves this object includes a toner container which is mounted to an image forming apparatus in a state of containing toners, the toner container comprising: a container body for containing toners; and an agitating unit provided in the container body for agitating the toners, and the agitating unit includes: a tubular member having a tubular peripheral wall and rotating about an axis of the tubular member; an opening formed in the tubular peripheral wall for allowing the toners to pass through; and a conveying section for conveying the toners in a direction of the axis of the tubular member.

These and other objects, features and advantages of the present invention will become more apparent upon reading of the following detailed description along with the accompanied drawings.

DETAILED DESCRIPTION OF THE PREFERRED EMBODIMENTS

Figure 1:
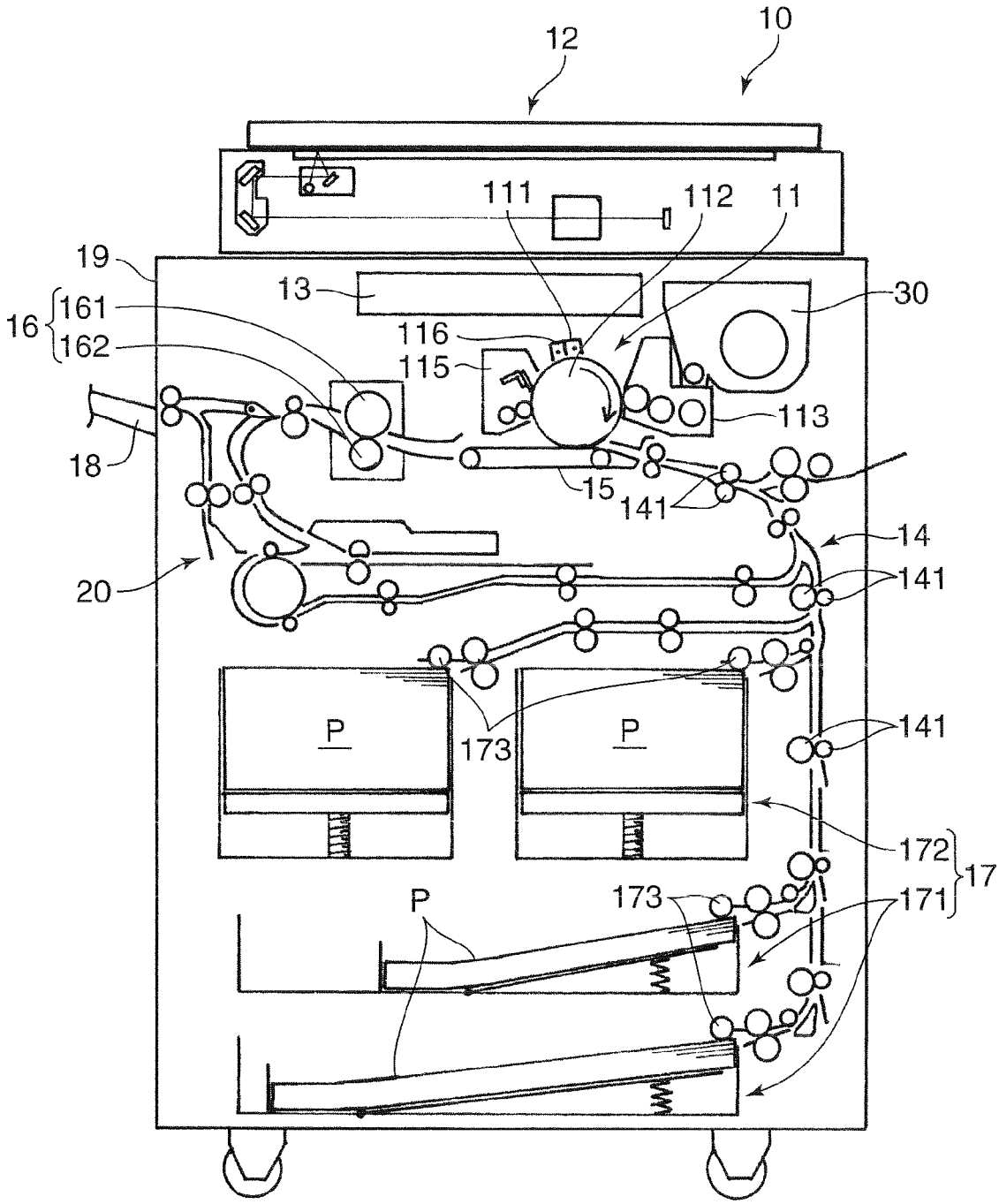
FIG. 1 is a front sectional view showing an overall configuration of an image forming apparatus to which a toner container in accordance with an embodiment of the present invention is mounted.

Hereinafter, an embodiment of the present invention will be described with reference to the drawings. FIG. 1 is a front sectional view showing an overall configuration of an image forming apparatus 10 with which a toner container in accordance with an embodiment of the present invention can be used. Firstly, with reference to FIG. 1, an overall configuration of the image forming apparatus 10 will be described. In FIG. 1, a copying machine is shown as an example of the image forming apparatus 10.

The image forming apparatus 10 includes an apparatus main body 19 and a document reading section 12 for reading a document image. In the apparatus main body 19, there are provided an image forming section 11, an exposure unit 13, a sheet conveying passage 14, a fixing device 16, and a sheet supplying section 17. Further, the image forming section 11 includes a charging unit 111, a photoconductive drum 112 having a peripheral surface on which an electrostatic latent image and a toner image are formed, a developing device 113, a cleaning device 115, and a charge-removing device 116.

At a time when a copying operation is performed, the charging unit 111 uniformly charges the peripheral surface of the photoconductive drum 112 which rotates in a direction of arrow (clockwise direction) in FIG. 1. On the peripheral surface of the photoconductive drum 112, an electrostatic latent image is formed by irradiation of a laser beam from the exposure unit 13 in accordance with document image data read by the document reading section 12. The developing device 113 supplies a developer (hereinafter, referred to as toners) for developing of the electrostatic latent image to the photoconductive drum 112 so as to form a toner image. The toners are supplied to the developing device 113 from a toner container 30 in accordance with the present embodiment.

The sheet supplying section 17 stores a large number of sheets P. A sheet P is conveyed to the image forming section 11 and toward the photoconductive drum 112 on which the toner image is formed from the sheet supplying section 17 through the sheet conveying passage 14 provided with a plurality of pairs of conveying rollers 141. The toner image bore on the peripheral surface of the photoconductive drum 112 is transferred to the sheet P by a transferring belt 15 in the image forming section 11. The sheet P onto which the toner image is transferred is separated from the photoconductive drum 112 and conveyed to the fixing device 16. The fixing device 16 includes a fixing roller 161, in which a heat source such as a halogen lamp is provided, and a pressing roller 162 whose peripheral surface comes in press-contact with a peripheral surface of the fixing roller 161, and the toner image is fixed on the sheet P by heat.

The cleaning device 115 scrapes off toners which remain on the peripheral surface of the photoconductive drum 112 after the transfer processing, and cleans the same. The charge-removing device 116 is provided on a downstream side of the cleaning device 115 and removes electric charge remaining on the peripheral surface of the photoconductive drum 112.

The sheet P which passes through the fixing device 16 is conveyed to a sheet conveying passage which branches off in a plurality of directions, and a conveying direction of the sheet P is sorted by a passage switching mechanism having a switching guide provided at a branching point of the sheet conveying passage on a sheet-discharging side for switching a plurality of sheet conveying passages. In a case of copying on one side, the sheet P is discharged directly to a sheet-discharging tray 18. In a case of a double-sided copying, the sheet P is conveyed to a double-sided copying conveying section 20 and switched front and back. Then, the sheet P is conveyed back to the image forming section 11 again, and copying is performed with respect to opposite sides. After the fixing processing is performed in the fixing device 16, the sheet P is discharged to the sheet-discharging tray 18.

The sheet supplying section 17 includes a plurality of sheet cartridges 171 for storing a small number of sheets P, a stocker 172 for stocking a large number of sheets P, and a pickup roller 173 for taking out an uppermost sheet from a sheet stack stored in the sheet cartridge 171 and the stocker 172 and sending the same to the image forming section 11 through the sheet conveying passage 14. The sheet cartridge 171 and the stocker 172 are dismountably mounted to the apparatus main body 19. If the sheet P is consumed to be empty, they are pulled out from the apparatus main body 19. Then, new sheets P are supplied, and the sheet cartridge 171 and the stocker 172 are pushed into the apparatus main body 19.

Figure 2:
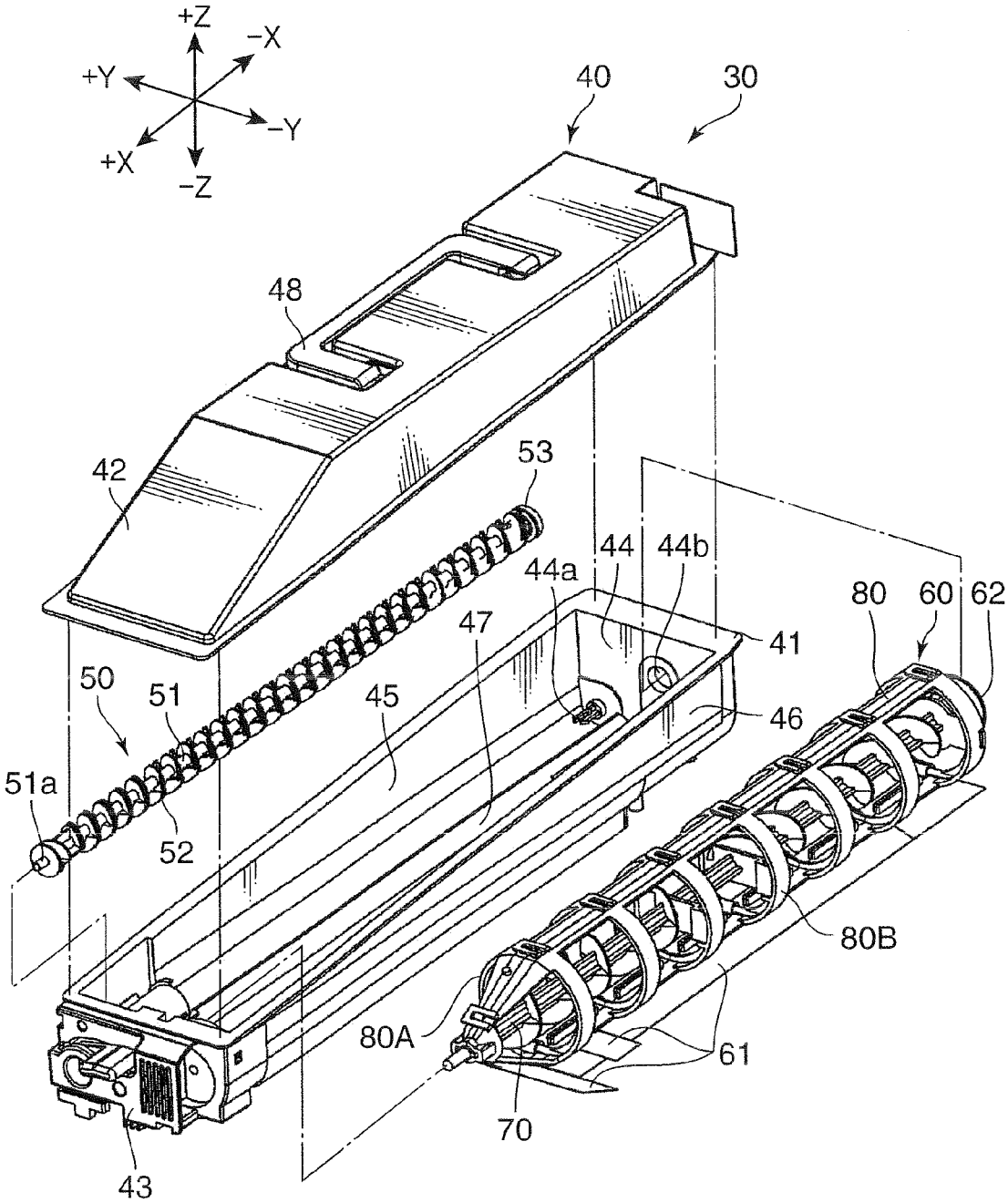
FIG. 2 is an exploded perspective view showing a configuration of the toner container.
Figure 3:
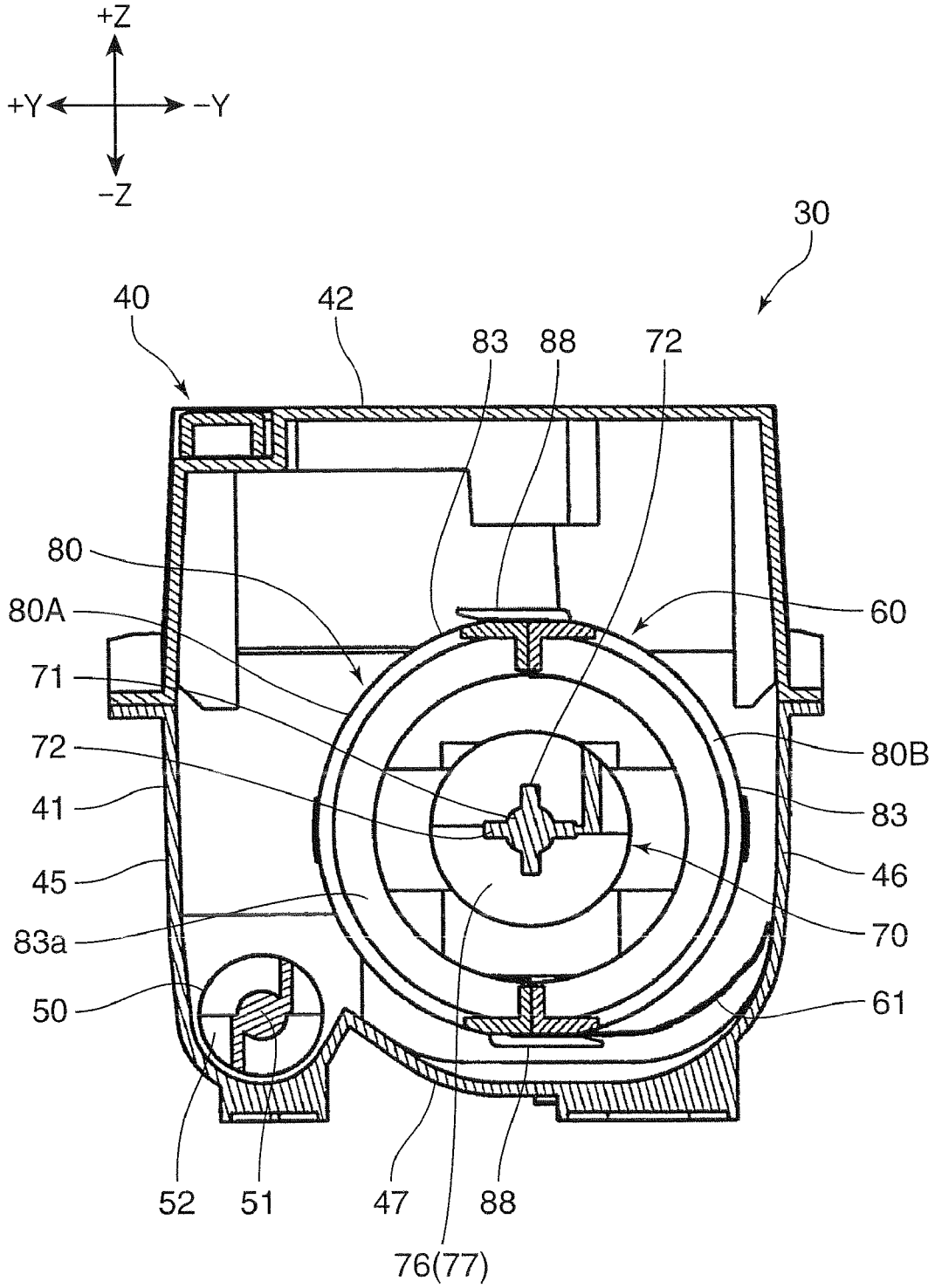
FIG. 3 is a front sectional view showing the toner container.
Figure 4:
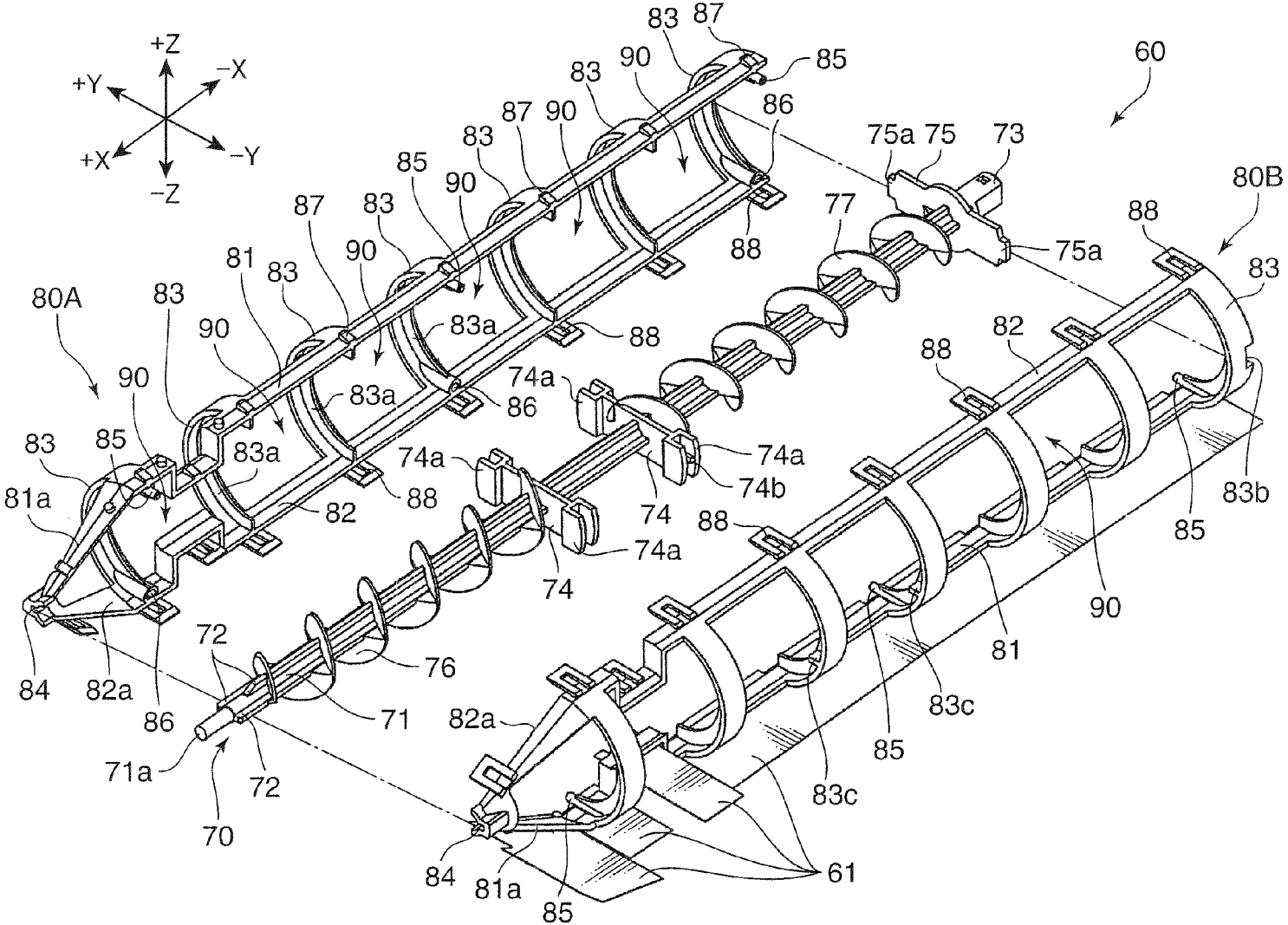
FIG. 4 is an exploded perspective view showing an agitating unit in accordance with a first embodiment.
Figure 5:
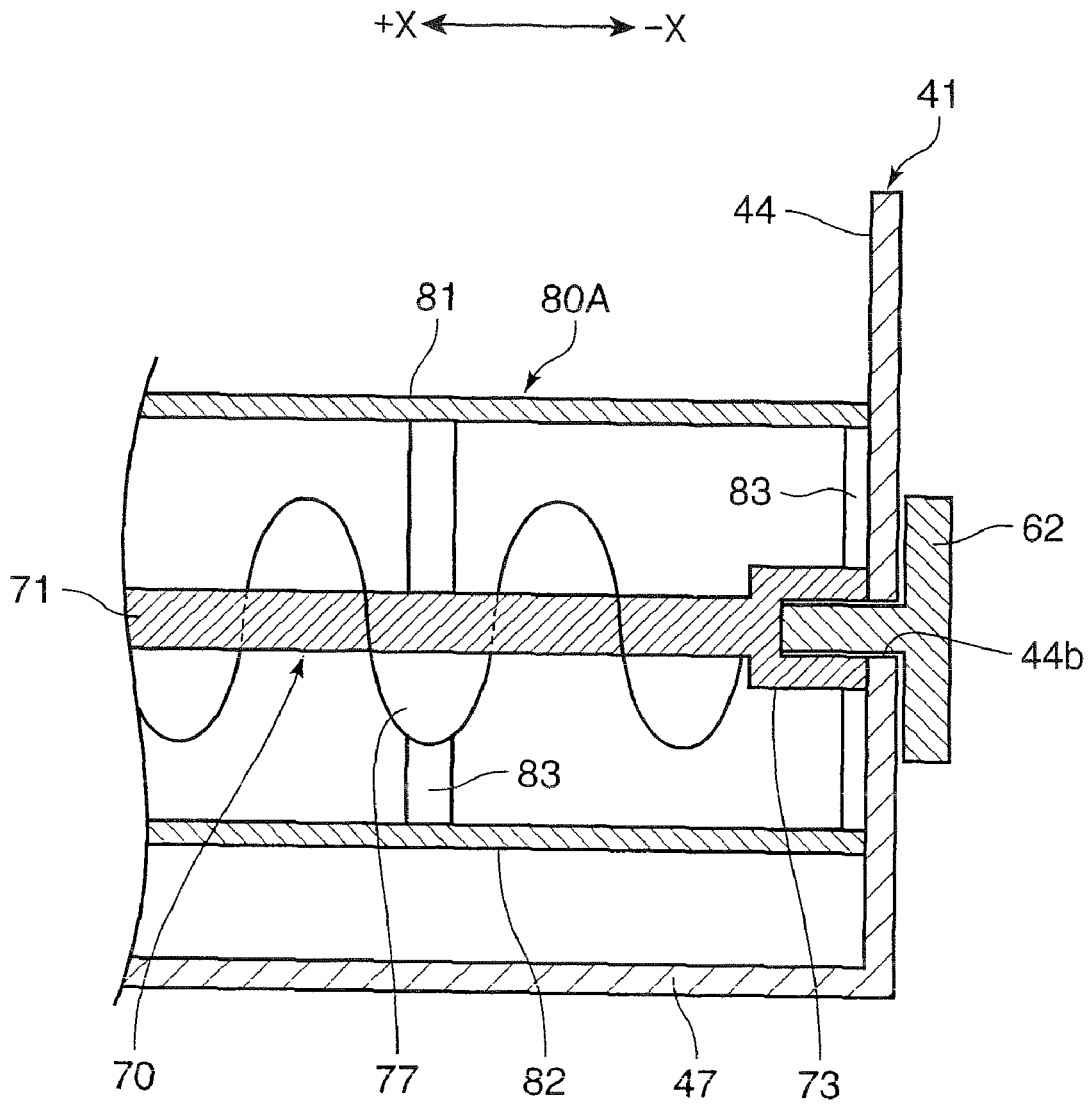
FIG. 5 is a side sectional view showing a structure of supporting the agitating unit with a container body.

FIG. 2 is an exploded perspective view of the toner container 30. FIG. 3 is a front sectional view of the toner container 30. Further, FIG. 4 is an exploded perspective view of an agitating unit 60 in accordance with a first embodiment. FIG. 5 is a side sectional view showing a structure of supporting the agitating unit 60 with a container body 40. In FIGS. 2-5, the X-X direction corresponds to a forward and backward direction. The Y-Y direction corresponds to a leftward and rightward direction. The Z-Z direction corresponds to a vertical direction. Specifically, +X direction corresponds to a frontward direction. The −X direction corresponds to a rearward direction. The +Y direction corresponds to a leftward direction. The −Y direction corresponds to a rightward direction. The +Z direction corresponds to an upward direction. The −Z direction corresponds to a downward direction.

The toner container 30 of the present invention is mounted to the image forming apparatus 10 in a state of containing the toners and supplies the toners to the developing device 113 in the image forming apparatus 10. The toner container 30 is of so-called cartridge type capable of being dismountably mounted to the image forming apparatus 10. If the amount of toners in the toner container 30 runs short, a user dismounts the toner container 30 from the image forming apparatus 10 and mounts the new toner container 30 containing a sufficient amount of toners. Accordingly, toners can be supplied continuously to the developing device 113.

As shown in FIGS. 2 and 3, the toner container 30 includes a container body 40, a supplying screw 50, and an agitating unit 60.

The container body 40 includes a container 41 and a cover 42 and accommodates the supplying screw 50 and the agitating unit 60 together with toners. The container 41 has a front side portion 43, a rear side portion 44, left and right side portions 45 and 46, and a lower side portion 47 and has a box-like shape having an open upper side.

At a lower left position of the front side portion 43, an unillustrated bearing portion for receiving the supplying screw 50 is formed. At a lower left position of the rear side portion 44, a drive transmission pin 44*a* which rotationally drives in a state of engaging with the supplying screw 50 is provided. The bearing portion and the drive transmission pin 44*a* supports the supplying screw 50 rotatably in the container 41 in such a posture as to extend in the forward and backward direction.

At a substantially center position of the front side portion 43, an unillustrated bearing portion for receiving a shaft member 70, which will be described hereinafter, of the agitating unit 60 is formed. At a substantially center position of the rear side portion 44, a through hole 44*b* for allowing a drive transmission gear 62 attached to the shaft member 70 of the agitating unit 60 to pass through and support the same (refer to FIG. 5) is formed. The bearing portion and the through hole 44*b* supports the agitating unit 60 rotatably in the container 41 in such a posture as to extend in the forward and backward direction.

In the lower side portion 47, an unillustrated toner-feeding opening for feeding toners to the developing device 113 is formed. Further, on the cover 42, a grip portion 48 to be gripped at a time of carrying the toner container 30 is provided.

The supplying screw 50 is provided at a lower left portion in the container body 40 and has a function of leading the toners in the container body 40 to the toner-feeding opening formed in the lower side portion 47. The supplying screw 50 includes a shaft portion 51, a screw portion 52 formed on an outer peripheral surface of the shaft portion 51, and a pin engaging portion 53 continuously provided at a rear end of the shaft portion 51.

The shaft portion 51 has a front end portion 51*a* retained by the unillustrated bearing portion of the front side portion 43. Further, the pin engaging portion 53 engages with the drive transmission pin 44*a*, and receives a drive force from the drive transmission pin 44*a*, so that the shaft portion 51 is rotated by the drive force. The rotation of the shaft portion 51 rotates the screw portion 52 in a circumferential direction and moves the toners along the shaft portion 51.

The agitating unit 60 is provided at a lower center position in the container body 40 and has a function of agitating the toners in the container body 40. Further, in the case where the toner container 30 is left for a long time and the toners inside are solidified, the agitating unit 60 serves to break down the solidified toners (hereinafter, sometimes referred to as "solidified toners").

As shown in FIGS. 2-4, the agitating unit 60 includes a shaft member 70 which is driven rotationally, and a circular cylinder body 80 (tubular member) which is provided coaxially on a radially outer side of the shaft member 70 so as to surround the shaft member 70 and rotates integrally with the shaft member 70.

As shown in FIG. 4, the shaft member 70 includes a shaft portion 71, four reinforcing ribs 72 extending in the axial direction and projecting from an outer peripheral surface of the shaft portion 71 at equal intervals (90 degrees) in the circumferential direction, a gear mounting portion 73 provided continuously from the rear end of the shaft portion 71, a pair of first position restricting portions 74 provided near an axial center of the shaft portion 71 and spaced apart by a predetermined clearance, a second position restricting portion 75 provided near the rear end of the shaft portion 71, a front side screw portion 76 (a part of the conveying section) provided in an outer periphery of an area on a front side of the front first position restricting portion 74 in the shaft portion 71, a rear side screw portion 77 (a part of the conveying section) provided on a rear side of the rear first position restricting portion 74 in the shaft portion 71. In an area between the pair of first position restricting portion 74 in the shaft portion 71, a screw portion is not formed.

The shaft portion 71 has a front end portion 71*a* which is retained by the unillustrated bearing portion of the front side portion 43. Further, as shown in FIG. 5, a gear mounting portion 73 is so configured as to be capable of mounting the drive transmission gear 62. A drive force given from the drive transmission gear 62 rotationally drives the shaft portion 71.

Each of the pair of front and rear first position restricting portions 74 extends in a direction perpendicular to the axial direction and has fork-end engaging portions 74*a* at opposite ends in the extending direction. The engaging portion 74*a* of the front first position restricting portion 74 engages with a semicircular rib 83*a* of a curved plate portion 83 provided at third from a front side among seven curved plate portions 83, which will be described hereinafter, of the circular cylinder body 80. The engaging portion 74*a* of the rear first position restricting portion 74 engages with a semicircular rib 83*a* of a curved plate portion 83 at fourth from a front side among the seven curved plate portions 83, which will be described hereinafter, of the circular cylinder body 80. These two first position restricting portions 74 fix relative positions of the shaft member 70 and the circular cylinder body 80 near a center in the axial direction. In each of the fork-end engaging portions 74*a*, a projection 74*b* for improving engagement with respect to the semicircular rib 83*a* is provided.

The second position restricting portion 75 extends in a direction perpendicular to the axial direction, and engaging pieces 75*a* are formed at opposite ends in the extending direction. The engaging pieces 75*a* fit into the notches of the curved plate portions 83 at the rear end among the seven curved portions 83, which will be described hereinafter, of the circular cylinder body 80 (seventh from the front side). The second position restricting portion 75 fixes relative positions of the shaft member 70 and the circular cylinder body 80 near the rear end.

The pair of screw portions 76 and 77 are members for moving toners in the axial direction of the shaft member 70, and its spiral direction is so set as to be capable of moving the toners from axially opposite ends toward a central portion in the present embodiment. In particular, the front side screw portion 76 has a spiral in a counter-clockwise direction toward a rear side in a front view. Specifically, semicircular plates are provided sequentially in the axial direction, so that a substantially spiral space is formed. The semicircular plates may be provided intermittently in the axial direction. The rear side screw portion 77 has a spiral in a clockwise direction toward a rear side in a front view. In the present embodiment, the shaft member 70 is rotationally driven in a clockwise direction in a front view.

The circular cylinder body 80 includes a pair of substantially semicircular plate-like (half-cut) first frame 80A and second frame 80B which are so provided as to face each other over the shaft member 70. Hereinafter, a configuration of the first frame 80A will be described hereinafter. The shape of the second frame 80B is the same as that of the first frame 80A rotated by 180 degrees about an axis.

The first frame 80A includes a pair of straight plate portions 81 and 82 extending in the axial direction, seven curved plate portions 83 (first curved plate portions) provided intermittently in the axial direction and extending in the circumferential direction so as to connect the straight plate portions 81 and 82, a rib retaining portion 84 formed at a connection portion between front sloping portions 81*a* and 82*a* provided respectively in front portions of the straight plate portions 81 and 82, positioning pins 85 provided near one end in extending direction of the first, fourth, and seventh curved plate portions 83 from a front side among the seven curved plate portions 83, pin insertion holes 86 formed near the other end in the extending direction of the first, fourth, and seventh curved plate portions 83 from a front side, hook portions 87 (first engaging portion) provided near one ends in the extending directions of the seven curved plate portions 83, hook engaged portions 88 (first engaged portion) provided near the other ends in the extending direction of the seven curved plate portions 83 and having a shape engageable with the hook portions 87.

Similarly, the second frame 80B includes the straight plate portions 81 and 82, the curved plate portions 83 (second curved portions), the rib retaining portion 84, the positioning pins 85, the pin insertion holes 86, the hook portions 87 (second engaging portions) and the hook engaged portions 88 (second engaged portions).

In an inner circumferential surface of each curved plate portion 83, there is provided a semicircular rib 83*a* projecting radially inwardly for reinforcing the curved plate portion 83. As described above, the semicircular ribs 83*a* of the third and fourth curved plate portions 83 engage with the engaging portions 74*a* of the pair of first position restricting portions 74 of the shaft member 70. Further, in each of the inner circumferential surfaces of the third and fourth curved plate portions 83 from the front side, there is formed a rotation stopper 83*c* which comes in contact with the engaging portion 74*a* of the first position restricting portion 74 to prevent the axially central portion of the shaft member 70 from rotating about an axis.

At a central rear end of the curved plate portion 83 at the rear end, there is formed a notch 83*b*. The engaging piece 75*a* of the second position restricting portion 75 of the shaft member 70 fits into the notch 83*b*.

The rib retaining portion 84 is so shaped that the reinforcing rib 72 of the shaft member 70 can be fitted. Accordingly, relative positions of the shaft member 70 and a periphery of the front end of the circular cylinder body 80 is fixed.

Each positioning pin 85 of the first frame 80A is inserted to a corresponding pin insertion hole 86 of the second frame 80B. Further, to each pin insertion hole 86 of the first frame 80A, a corresponding positioning pin 85 of the second frame 80B is inserted.

Each hook portion 87 of the first frame 80A engages with a corresponding hook engaged portion 88 of the second frame 80B. Further, to each hook engaged portion 88 of the first frame 80A, a corresponding hook portion 87 of the second frame 80B is engaged.

The first frame 80A has six openings 90 arranged sequentially in the axial direction. The openings 90 are formed by being surrounded by the pair of straight plate portions 81 and 82 and the seven curved plate portions 83. The openings 90 might be formed in the first frame 80A and near portions corresponding at least to respective front and rear end portions of the pair of screw portions 76 and 77 of the shaft member 70, and have a function of allowing the toners to pass through. Similarly, the second frame 80B has six openings 90.

Assembling of the agitating unit 60 in accordance with the first embodiment is performed as follows. In a state of sandwiching the shaft member 70, the pair of frames 80A and 80B come close to each other from relatively opposite positions in the direction perpendicular to the axis of the shaft member 70. Then, the hook portions 87 of the first frame 80A and the seven hook engaged portions 88 of the second frame 80B are engaged. Further, the seven hook portions 87 of the second frame 80B are engaged with the seven hook engaged portions 88 of the first frame 80A. Accordingly, the pair of frames 80A and 80B are fitted and integrated while sandwiching the shaft member 70, so that the agitating unit 60 having a cylindrical shape is completed.

In the assembled agitating unit 60, three positioning pins 85 of the first frame 80A are inserted to three corresponding pin insertion holes 86 of the second frame 80B, and the three positioning pins 85 of the second frame 80B are inserted to the three corresponding pin insertion holes 86 of the first frame 80A. Accordingly, relative positions of the frames 80A and 80B are fixed.

Further, the pair of reinforcing ribs 72 extending in the leftward and rightward directions in FIG. 4 of the shaft portion 71 are retained by the rib retaining portions 84 of the frames 80A and 80B. Accordingly, relative positions of the shaft member 70 and the rear end of the circular cylinder body 80 are fixed.

Further, the pair of engaging portions 74*a* of the front first position restricting portion 74 of the shaft portion 71 engage with the semicircular ribs 83*a* of the third curved plate portions 83 from the front side of the frames 80A and 80B, and the pair of engaging portions 74*a* of the rear first position restricting portion 74 of the shaft portion 71 engage with the semicircular ribs 83*a* of the fourth curved plate portions 83 from the front side of the frames 80A and 80B. Accordingly, relative positions of the shaft member 70 and the circular cylinder body 80 at a center are fixed.

Furthermore, the pair of engaging pieces 75*a* of the second position restricting portion 75 of the shaft portion 71 fit into the notches 83*b* of the curved plate portions 83 at the rear ends of the frames 80A and 80B, so that relative positions of the shaft member 70 and the rear end of the circular cylinder body 80 are fixed.

As shown in FIG. 2, in the assembled agitating unit 60, the semicircular plate-like curved plate portions 83 provided on the frames 80A and 80B are connected so that a configuration is formed as if seven ring pieces are arranged at predetermined intervals along the axial direction (direction of the axis of cylinder) of the shaft member 70. Further, the straight plate portions 81 and 82 are configured to connect these ring pieces. The openings 90 are formed at clearances formed between adjacent ring pieces.

As shown in FIGS. 3 and 4, films 61 made of PET (polyethylene terephthalate) are attached to the agitating unit 60, as shown in FIGS. 3 and 4. In the present embodiment, the films 61 extends outwardly from a position near the straight plate portion 81 of the second frame 80B (more specifically, near the clearance between the straight plate portion 81 of the second frame 80B and the hook engaged portions 88 of first frame 80A). A function of the films 61 is to come in contact with the solidified toners existing in an outer area of the circular cylinder body 80 of the agitating unit 60 to break down and refine the toners.

Next, an operation of the agitating unit 60 will be described. For example, if the toner container 30 is left for a long time, toners accommodated in the container body 40 are solidified in some cases. Particular, in a state where the toner container 30 is standing, the toners in the container body 40 come to one side. In such state, if the toner container 30 is vibrated, the toners are solidified strongly. In this case, if an agitating operation is started with a conventional agitating member, a great load is applied to the agitating member.

In the agitating unit 60 of the present embodiment, a drive force is applied from an unillustrated drive power source to the shaft member 70 through the drive transmission gear 62. Accordingly, the shaft member 70 is rotated, and the circular cylinder body 80 is also rotated. At this time, since the circular cylinder body 80 is provided coaxially with the shaft member 70, the circular cylinder body 80 is not displaced in the radial direction. Thus, at a time of starting the agitating unit 60, it can prevent an operation that the circular cylinder body 80 rotates while breaking down the solidified toners can be suppressed as small as possible, so that a load applied to the circular cylinder body 80 becomes sufficiently small.

When the rotational operation of the agitating unit 60 is started, the circular cylinder body 80 is rotated, so that the solidified toners are separated into an inner side and outer side of the circular cylinder body 80 by the circular cylinder body 80. Then, the screw portions 76 and 77 provided on the shaft member 70 move the solidified toners, which are separated by the circular cylinder body 80 and remain on an inner side in the circular cylinder body 80, in the axial direction and finely breaks down the same. Further, excessive toners at a moved position on an inner side of the circular cylinder body 80 (near center position of the shaft member 70) pass through the opening 90 of the circular cylinder body 80 appropriately and flow out of the circular cylinder body 80. On the other hand, in a space formed at an original position of toners inside the circular cylinder body 80 (near opposite ends of the shaft member 70), the toners on an outer side of the circular cylinder body 80 pass through the opening 90 and enter. Accordingly, by rotating the agitating unit 60, the solidified toners are finely broken down, and a circulating passage for the broken toners is formed easily.

As described above, according to the toner container 30 provided with the agitating unit 60 in accordance with the first embodiment, the circular cylinder body 80 which integrally rotates with the shaft member 70 is provided. Accordingly, the toners solidified in the container body 40 are separated into an inner side and outer side of the circular cylinder body 80 by the circular cylinder body 80. Further, since the screw portions 76 and 77 for moving the toners in the axial direction are provided on the shaft member 70, the solidified toners which are separated by the circular cylinder body 80 and remain in the circular cylinder body 80 can be moved in the axial direction and finely broken down by the screw portions 76 and 77.

Further, since the openings 90 for allowing the toners to pass through are formed at appropriate portions of the circular cylinder body 80, the toners can be moved from the inner side to the outer side of the circular cylinder body 80, or from the outer side to the inner side freely. As described above, the agitating unit 60 rotates to finely break down the solidified toners and form a circulating passage of the broken toners. Accordingly, the toners can be easily and efficiently stirred.

Further, in the first embodiment, the circular cylinder body 80 is provided so as to be coaxial with the shaft member 70. Accordingly, at a time when the rotation of the shaft member 70 moves the circular cylinder body 80 in the circumferential direction, the radial position of the circular cylinder body 80 is not displaced. Accordingly, at a time of starting the agitating unit 60, rotation of the circular cylinder body 80 while breaking down the solidified toners can be suppressed to be small. Accordingly, applying of a great load from the circular cylinder body 80 to the solidified toners can be suppressed, so that the agitating operation by the agitating unit 60 can be started at a relatively low torque.

Herein, a comparative experiment will be described which was performed to prove an effect of the present embodiment that the agitating unit 60 can be started to rotate at a low torque. In this experiment, firstly, a torque was measured which is necessary to start agitating solidified toners in the toner container 30 provided with the agitating unit 60 in accordance with the first embodiment. As a result, rotation of the agitating unit 60 is started at a torque of 2.5 kgf·cm.

Figure 6:
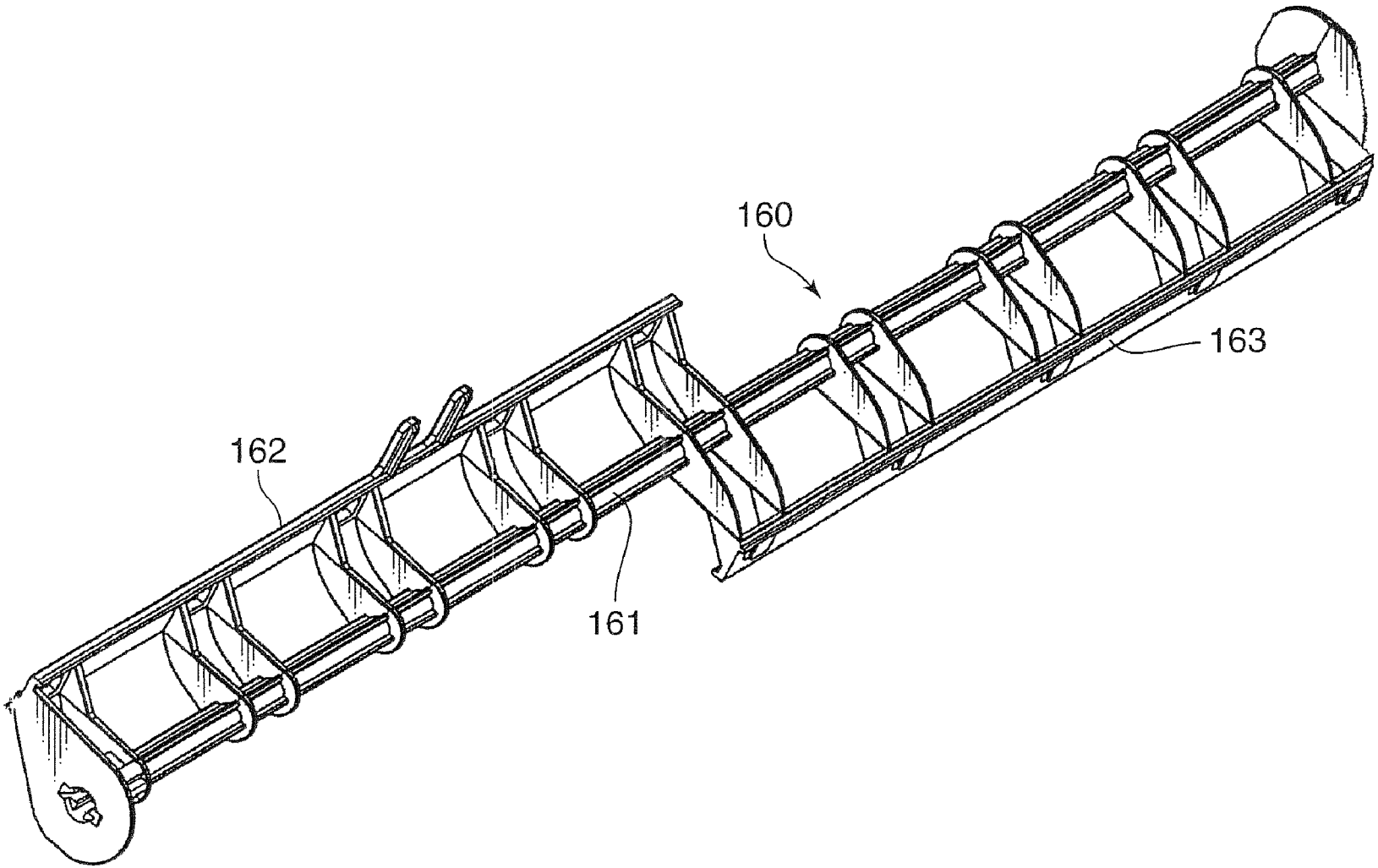
FIG. 6 is a perspective view showing a configuration of the agitating unit according to a comparative example.

Next, in a toner container provided with an agitating member 160 having a shaft 161 on a periphery of which a pair of agitating portions 162 and 163 are formed as shown in FIG. 6 as a comparative example, a torque necessary to start agitating the solidified toners was measured. As a result, rotation of the agitating member 160 was started at a torque of 24.0 kgf·cm.

According to the above, it was found that an agitating operation is started at a torque of one-tenth in the toner container 30 provided with the agitating unit 60 of the present embodiment, as compared to the toner container provided with the agitating member 160 of the comparative example. Accordingly, it could be understood that the effect described above can be achieved sufficiently.

Further, in the first embodiment, the circular cylinder body 80 includes two frames 80A and 80B. Therefore, assembling and disassembling of the circular cylinder body 80 becomes easy, so that maintainability improves.

Further, spiral directions of the screw portions 76 and 77 are so set that the toners are movable toward the central portion in the axial direction of the shaft member 70. Thus, rotation of the agitating unit 60 can move the broken toners from the opposite end portions of the shaft member 70 toward the center. Accordingly, even if the toners are on one side in the axial direction and solidified, moving of the broken toners successively to the side on which much solidified toners exist can be prevented. Thus, occurrence of malfunctioning in rotation of the agitating unit 60 due to absence of a place for toners to move into can be prevented.

Figure 7:
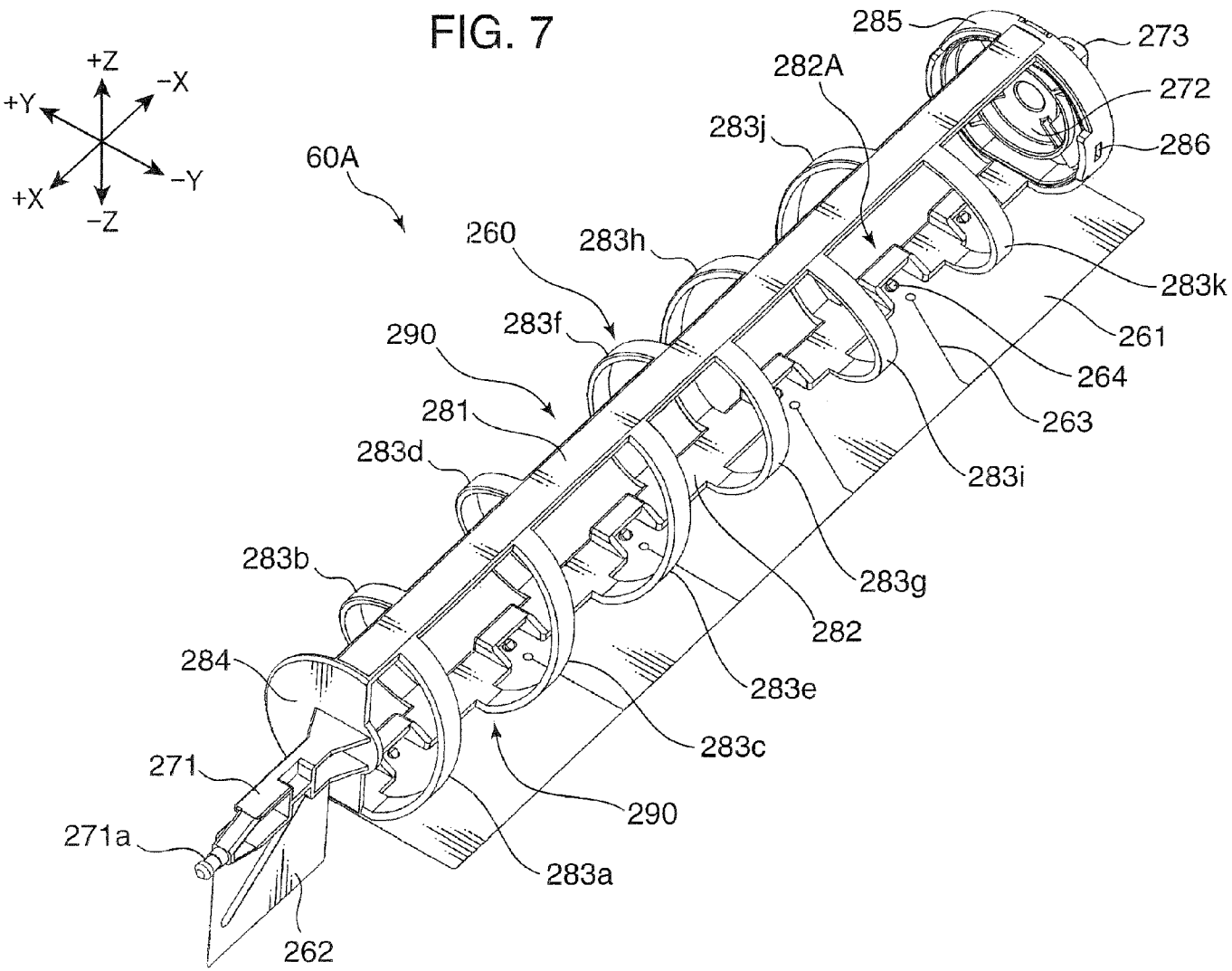
FIG. 7 is a perspective view showing the agitating unit in accordance with a second embodiment.
Figure 8:
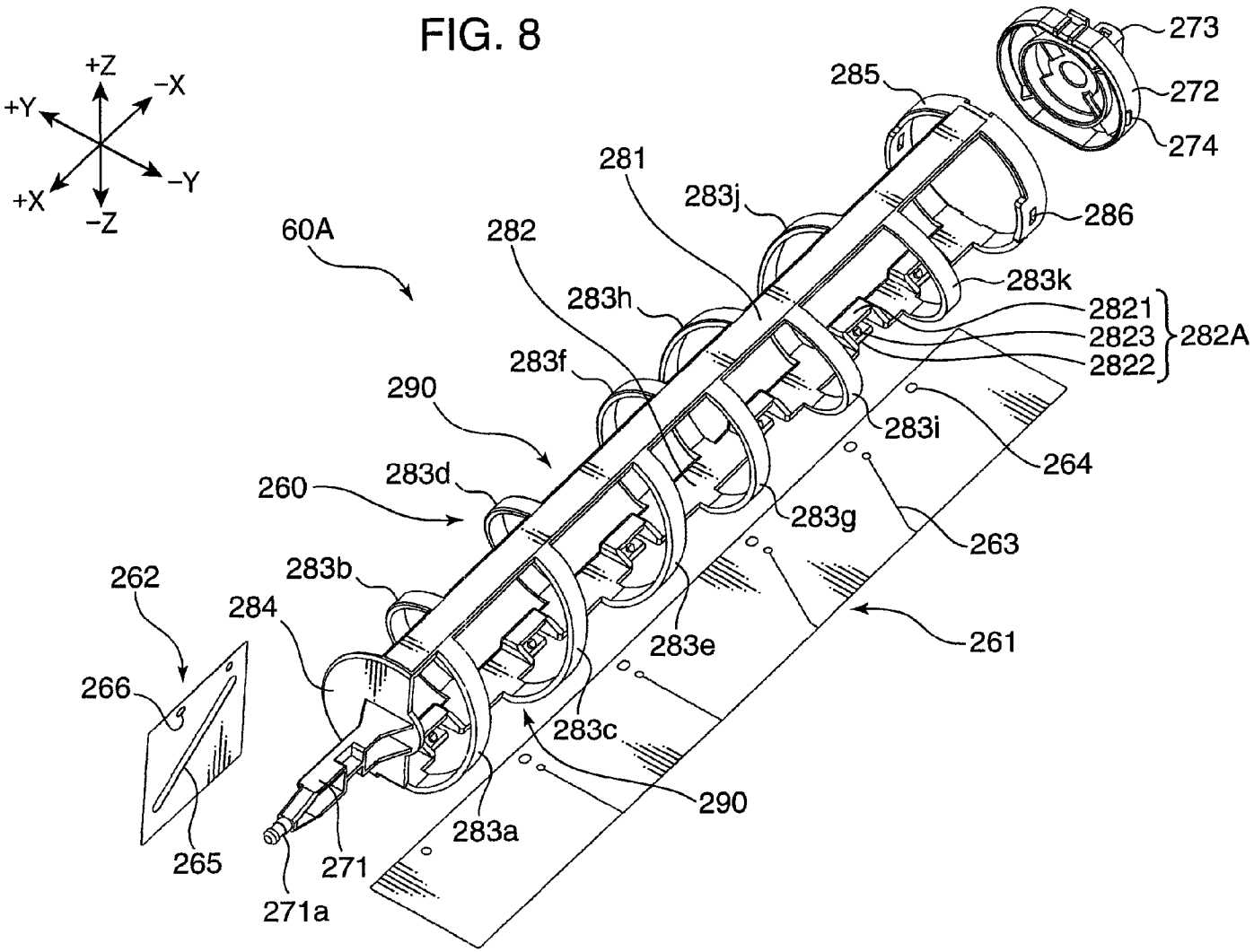
FIG. 8 is an exploded perspective view of the agitating unit in accordance with the second embodiment.

Next, an agitating unit 60A (circular cylindrical member) in accordance with a second embodiment will be described. FIG. 7 is a perspective view of the agitating unit 60A. FIG. 8 is an exploded perspective view of the agitating unit 60A. The agitating unit 60A includes a circular cylindrical main body 260 molded to have a first straight plate portion 281 and a second straight plate portion 282 (a pair of straight plate portions) and first through eleventh semicircular arched pieces 283*a*-283*k*. The agitating unit 60A further includes a first film member 261, a second film member 262, and an end portion element 272.

The first straight plate portion 281 and the second straight plate portion 282 are band-like portions extending parallel to the direction of axis of the main body 260. The first through eleventh arched pieces 283*a*-283*k* are band-like portions which extend between the first straight plate portion 281 and the second straight plate portion 282 and curve to have a semicircular shape. On a right (−Y) side of the plane connecting the first straight plate portion 281 and the second straight plate portion 282, there are arranged first, third, fifth, seventh, ninth, and eleventh arched piece 283*a*, 283*c*, 283*e*, 283*g*, 283*i*, and 283*k* (first arched pieces) at predetermined intervals in the direction of the axis of cylinder. On a left (+Y) side, there are arranged second, fourth, sixth, eight, and tenth arched pieces 283*b*, 283*d*, 283*f*, 283*h*, and 283*j* (second arched pieces) at predetermined intervals in the direction of the axis of cylinder.

The clearances between the arched pieces are openings 290 in the present embodiment. The openings 290 allow communication between inside and outside of the circular cylindrical main body 260, so that toners can freely enter and go out.

On a front (+X) end portion of the main body 260, there is provided a semicircular end plate 284. The end plate 284 is integrally formed with a shaft portion 271 projecting forward. A front end portion 271*a* of the shaft portion 271 is retained freely rotatably by an unillustrated bearing portion provided in a front side portion 43 of the container body 40 (refer to FIG. 2). On an end portion on a rear (−X) side of the main body 260, there is provided a ring-like piece 285 to which the end portion element 272 is mounted.

In the agitating unit 60A in accordance with the second embodiment, unlike the first embodiment, a shaft member 70 having a toner conveying function is not used separately, but the circular cylindrical main body 260 itself has a toner conveying function. Therefore, a major part of the first through eleventh arched pieces 283*a*-283*k* slant at a predetermined angle with respect to the direction (plane) perpendicular to the direction of the axis of the main body 260, and extends between the first straight plate portion 281 and the second straight plate portion 282.

Specifically, the first through fifth arched pieces 283*a*-283*e* slant so that the first through fifth arched pieces 283*a*-283*e* substantially form a spiral body being spiral in the counter-clockwise direction in a view from a front side of the main body 260. Further, the eighth through eleventh arched pieces 283*h*-283*k* slant so that the eighth through eleventh arched pieces 283*h*-283*k* substantially form a spiral body being spiral in the clockwise direction from a front side of the main body 260, similarly. The sixth and seventh arched pieces 283*f* and 283*g* which are positioned at a substantially central portion in the direction of the axis of cylinder of the main body 260 do not substantially slant with respect to the direction perpendicular to the direction of the axis of the main body 260.

As described above, the first through fifth arched pieces 283*a*-283*e* form a counter-clockwise spiral body on a front side in the direction of the axis of cylinder of the main body 260, and the eighth through eleventh arched pieces 283*h*-283*k* form a clockwise spiral body on a rear side. Accordingly, rotation of the main body 260 achieves a toner conveying function of the agitating unit 60A. In other words, the side wall portion of the arched pieces slanting spirally achieves an effect of moving toners by rotation of the main body 260. In the present embodiment, the toners are moved from the opposite end portions in the axis of cylinder of the main body 260 toward the central portion.

To the ring-like piece 285, the end portion element 272 having a shape of a circular lid is fitted. The end portion element 272 has a gear mounting portion 273 projecting rearwardly, and an engaging claw 274 provided on a side peripheral wall.

The gear mounting portion 273 is a portion which is similar to the gear mounting portion 73 of the first embodiment and to which a rotational drive force is inputted from the drive transmission gear 62 like the one shown as an example in FIG. 5. The engaging claw 274 is a member for fixing the end portion element 272 to the main body 260 and engages with an engaging hole 286 formed in the ring-like piece 285. The rotational drive force is given to the gear mounting portion 273, so that the main body 260 rotates about the axis of cylinder.

The first film member 261 is a rectangular film which is long in the direction of the axis of cylinder of the main body 260 and is attached to the second straight plate portion 282. The first film member 261 includes a plurality of slits 263 extending from a free end side toward a short side direction of the rectangle, and attaching holes 264 arranged on a base end side. On the other hand, the second straight plate portion 282 is provided with fixing portions 282A for attaching the first film member 261 correspondingly to the attaching holes 264.

Each fixing portion 282A has a snap-fit structure, and has a recession 2821 which is formed by partially recessing the second straight plate portion 282 toward the axis of cylinder, an elastically deformed piece 2822 having a home position of partially entering a cavity of the recession 2821, and a pin 2823 which projects from a surface of the elastically deformed piece 2822 on the side of the cavity, as shown in FIG. 8. The pin 2823 is so sized as to be fitted into the attaching hole 264 of the first film member 261.

At a time of attaching the first film member 261, the elastically deformed piece 2822 is deformed in a direction of separating apart from the cavity, and a base end of the first film member 261 is received between the recession 2821 and the elastically deformed piece 2822. Then, by restoring the elastically deformed piece 2822 in a state where the pin 2823 is fitted into the attaching holes 264, the first film member 261 is fixed to the second straight plate portion 282 (refer to FIG. 7).

The second film member 262 is a small film piece having a rectangular shape and attached to the shaft portion 271, and includes a slit 265 and mounting holes 266. The mounting holes 266 are fitted to unillustrated pins provided on the shaft portion 271, so that the second film member 262 is fixed to the shaft portion 271.

The first film member 261 and the second film member 262 are moved in the circumferential direction by rotation of the main body 260. Its function is to come in contact with the solidified toners existing in the main body 260 and an outer area of the shaft portion 271 to gradually scrape off and atomize the toners.

According to the toner container 30 provided with the agitating unit 60A in accordance with the second embodiment, the rotating circular cylindrical main body 260 is provided, so that toners solidified in the container body 40 can be separated into inside and outside of the main body 260 by the main body 260. Further, since the first through fifth arched pieces 283*a*-283*e* and eighth through eleventh arched pieces 283*h*-283*k* of the main body 260 have a function of moving the toners in the direction of the axis of cylinder, the solidified toners separated by the main body 260 can be atomized while being moved in the direction of the axis of cylinder of the main body 260.

Further, since the main body 260 has openings 290 for allowing the toners to pass through, the toners can be moved freely from inside to outside or outside to inside of the main body 260. By rotating the agitating unit 60A in such a manner, the solidified toners are broken down finely, and a passage for circulating the broken toners can be formed easily. Accordingly, the toners can be stirred easily and efficiently.

In the above, embodiments of the present invention are described. However, the present invention is not limited to those, and the following contents are included.

(1) In the embodiments above, a copying machine is described as an example of the image forming apparatus 10. However, the image forming apparatus 10 may be a printer or a facsimile machine.

(2) In the first embodiment, it is described as an example that a spiral direction of the front side screw portion 76 and a spiral direction of the rear side screw portion 77 are opposite to each other. Further, in the second embodiment, it is described as an example that the spiral directions of the first through fifth arched pieces 283*a*-283*e* and eight h through eleventh arched pieces 283*h*-283*k* are different from one another. However, not limited to this, the spiral directions of the front and rear screw portions 76 and 77, and the spiral directions of the arched pieces 283*a*-283*k* may be configured to be the same.

(3) In the first embodiment, it is described as an example that the circular cylinder body 80 includes a pair of frames 80A and 80B. However, similarly to the second embodiment, the circular cylinder body 80 may be integrally molded. On the other hand, similarly to the first embodiment, the circular cylindrical main body 260 in accordance with the second embodiment may be a pair of half-cut members.

(4) In the embodiments above, the toner container 30 for supplying toners to the developing device 113 of the image forming apparatus 10 is described as an example. However, not limited to this, the present invention can be applied to a so-called one-component developing device integrally including a developing device and a toner container.

(5) In the first embodiment, an example is described in which the shaft member 70 and the circular cylinder body 80 are combined to rotate integrally. Not limited to this, the shaft member 70 and the circular cylinder body 80 may be in a non-engaged state and rotated by separate drive power sources. Further, similarly to the second embodiment, the circular cylinder body 80 may have an ability to convey toners.

(6) In the embodiments above, an example is described in which the openings 90 and 290 are clearances between the curved plate portions 83 or the arched pieces 283*a*-283*k*. Alternatively, the openings may be formed only on opposite end portions in the axial directions of the circular cylinder body 80 or the main body 260. In this case, it is sufficient that the conveying section for conveying toners conveys toners in one direction of the axial direction.

(7) In the embodiments above, an example is described in which the circular cylinder body 80 and the main body 260 have a cylindrical shape. However, it is not necessary that these have a circular cylindrical shape, as long as they are a tubular body.

The embodiments described above include the invention having the following configurations.

A toner container in accordance with an aspect of the present invention includes a toner container which is mounted to an image forming apparatus in a state of containing toners, the toner container comprising: a container body for containing toners; and an agitating unit provided in the container body for agitating the toners. The agitating unit includes: a tubular member having a tubular peripheral wall and rotating about an axis of the tubular member; an opening formed in the tubular peripheral wall for allowing the toners to pass through; and a conveying section for conveying the toners in a direction of the axis of the tubular member.

According to this configuration, a tubular member which rotates in the axis of the tubular member is provided. Accordingly, the solidified toners which are left for a long time can be separated into inside and outside by the tubular member. Further, since a conveying section for moving the toners in the direction of the axis of the tubular member is provided, the separated solidified toners can be broken down finely while being moved in the direction of the axis of the tubular member. Further, since an opening for allowing the toners to pass through is formed in the tubular peripheral wall. Accordingly, toners can move freely between inside and outside of the tubular member, so that a passage for circulating toners can be formed. Thus, rotation of the agitating unit finely breaks down the solidified toners, and the passage for circulating the broken toners can be easily formed, so that the toners can be stirred easily and efficiently.

Further, in the configuration above, it is preferable that the tubular member has a cylindrical shape. According to this configuration, a space factor of the tubular member in the container body can be made large, so that toners in every corner can be easily broken down.

In the configuration above, it is preferable that the opening is formed in at least portions corresponding to opposite ends in the direction of the axis of the tubular member. According to this configuration, a preferable passage for circulating toners can be formed.

In the configuration above, it is preferable that the tubular member includes: a plurality of ring pieces arranged at predetermined intervals along the direction of the axis of the tubular member; and a straight plate member connecting the plurality of ring pieces and extending in the direction of the axis of the tubular member, and the opening is a clearance between the ring pieces adjacent to each other. According to this configuration, a tubular member having an opening can be constructed by assembling the plurality of ring pieces and the straight plate member, so that productivity can be improved.

In the configuration above, it is preferable that the agitating unit includes: a shaft member which rotationally drives in a state of being supported by the container body; and a circular cylinder body which is provided coaxially on a radially outer side of the shaft member in such a manner as to surround the shaft member, and rotates about an axial center of the shaft member, and the conveying section is provided along the axial direction of the shaft member and moves the toners with rotational driving of the shaft member in the axial direction, and the opening is formed in portions corresponding to opposite end portions in the axial direction of the conveying section.

According to this configuration, since the rotating circular cylinder body is provided, the solidified toners which are left for a long time can be separated into inside and outside of the circular cylinder body by the circular cylinder body. Since the shaft member has a conveying section for moving toners in the axial direction, the solidified toners separated by the circular cylinder body and accommodated in the circular cylinder body can be broken down finely while being moved in the axial direction by the conveying section. Further, since an opening is formed in the circular cylinder body, excessive toners at a moved position on an inner side of the circular cylinder body (area corresponding to one end in the axial direction of the conveying section) pass through the opening of the circular cylinder body appropriately and flow out of the circular cylinder body, and toners on the outer side of the circular cylinder body pass through the opening and fall into a space formed at an original position of the toners inside the circular cylinder body (area corresponding to the other end in the axial direction of the circular cylinder body). Accordingly, rotation of the agitating unit finely breaks down the solidified toners, and a passage for circulating the broken toners is formed easily, so that the toners can be agitated easily and efficiently.

In this case, it is preferable that the circular cylinder body includes: a semicircular plate-like first frame having a pair of straight plate portions extending in the axial direction and a plurality of semicircular first curved plate portions provided intermittently in the axial direction and extending in a circumferential direction so as to connect the straight plate portions; and a semicircular plate-like second frame having straight plate portions and second curved plate portions which are similar to those of the first frame, and the first frame and the second frame are integrated so as to form a circular cylinder body. According to this configuration, by configuring the circular cylinder body to include a pair of frames, assembling and disassembling of the circular cylinder body becomes easy, so that maintainability improves.

In this case, it is preferable that a first engaging portion is provided on one end in an extending direction of the first curved plate portion, and a first engaged portion is provided on the other end, and a second engaged portion which is so shaped as to be engageable with the first engaging portion is provided on one end in an extending direction of the second curved portion, and a second engaging portion which is engageable with the first engaged portion is provided on the other end, and an engagement between the first engaging portion and the second engaged portion, and an engagement between the second engaging portion and the first engaged portion forms the circular cylinder body. According to this configuration, assembling and disassembling of the circular cylinder body becomes easier.

In the configuration above, it is preferable that the conveying section moves the toners from the opposite end portions in the axial direction of the shaft member toward an axial center portion.

According to this configuration, the broken toners can be moved toward an axial center of the shaft member. Accordingly, even if the toners are solidified on one side in the axial direction, the broken toners are prevented from being conveyed successively to the side where much solidified toners exit. Thus, occurrence of malfunctioning in rotation of agitating unit due to absence of a place for toners to move into can be prevented.

In the configuration above, it is preferable that a film member attached to the straight plate portion is further provided. According to this configuration, the solidified toners outside of the cylindrical member can be broken positively.

It is preferable that the ring piece has a slanting surface which slants in a direction perpendicular to the direction of the axis of the tubular member, and the slanting surface is the conveying section. According to this configuration, since the ring piece may have a function to convey toners, the number of parts can be reduced.

In the configuration above, it is preferable that the tubular member includes: a pair of straight plate portions arranged parallel to the direction of the axis of the tubular member at predetermined intervals; and a plurality semicircular arched pieces provided between the pair of straight plate portions, and the arched pieces are arranged at predetermined intervals in the direction of the axis of the tubular member, and the opening is formed between the arched pieces adjacent to each other, and the arched pieces are provided between the pair of straight plate portions in such a manner as to be slanted toward the direction perpendicular to the direction of the axis of the tubular member, so that a function of the conveying section is provided.

According to this configuration, since the semicircular arched piece may have a function to convey toners, it becomes not necessary to arrange a conveying section, so that the number of parts can be reduced.

In this case, it is preferable that the arched pieces include: first arched pieces positioned on one side of a plane connecting the pair of straight plate portions; and second arched pieces positioned on the other side, and the first arched pieces and the second arched pieces slant so that the first arched pieces and the second arched pieces substantially form a spiral body. According to this configuration, a toner-conveying ability of the arched piece can be made better.

In this case, it is preferable that conveyance of the toners by the arched pieces move the toners from the opposite end portions of the straight plate portions toward a center portion.

In the configuration above, it is preferable that a film member attached to the straight plate portion is further provided.

A toner container in accordance with another aspect of the present invention includes: a container body for containing toners; and an agitating unit provided in the container body for agitating the toners, and the agitating unit includes: a shaft member which rotationally drives in a state of being supported by the container body; and a circular cylinder body which is provided coaxially on a radially outer side of the shaft member in such a manner as to surround the shaft member, and rotates about an axial center of the shaft member, and the shaft member has a conveying section provided along the axial direction for conveying the toners with rotational driving of the shaft member in the axial direction, and an opening for allowing the toners to pass through is formed in portions corresponding to at least opposite ends of the conveying section in the axial direction of the circular cylinder body.

According to this configuration, rotation of the agitating unit breaks down the solidified toners and conveys the broken toners. Accordingly, the toners can be stirred easily and efficiently.

A toner container in accordance with yet another aspect of the present invention includes: a container body for containing toners; and a circular cylindrical member which is provided in the container body and rotates about an axis of the cylindrical member, and the circular cylindrical member includes: a main body section which is formed to have a circular cylindrical shape; a conveying section which is formed as a portion of the main body and conveys the toners in the direction of the axis of the cylindrical member; and an opening for communication between inside and outside of the main body.

According to this configuration, rotation of the agitating unit breaks down the solidified toners and conveys the broken toners. Accordingly, the toners can be stirred easily and efficiently.

This application is based on Japanese Patent application serial No. 2007-231855 filed in the Japanese Patent Office on Sep. 6, 2007, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A toner container which is mounted to an image forming apparatus in a state of containing toners, the toner container comprising:

a container body for containing toners; and an agitating unit provided in the container body for agitating the toners, wherein the agitating unit includes:

a tubular member having a cylindrically shaped peripheral wall and rotating about an axis of the tubular member;

an opening formed in the tubular peripheral wall for allowing the toners to pass through; and a conveying section for conveying the toners in a direction of the axis of the tubular member; wherein the tubular member includes:

a plurality of ring pieces arranged at predetermined intervals along the direction of the axis of the tubular member; and a straight plate member connecting the plurality of ring pieces and extending in the direction of the axis of the tubular member, wherein the opening is a clearance between the ring pieces adjacent to each other.

2. The toner container according to claim 1, wherein the opening is formed in at least portions corresponding to opposite ends in the direction of the axis of the tubular member.

3. The toner container according to claim 1, further comprising: a film member attached to the straight plate member.

4. The toner container according to claim 1, wherein the ring piece has a slanting surface which slants in a direction perpendicular to the direction of the axis of the tubular member, and the slanting surface is the conveying section.

5. A toner container which is mounted to an image forming apparatus in a state of containing toners, the toner container comprising:

a container body for containing toners; and an agitating unit provided in the container body for agitating the toners, wherein the agitating unit includes:

a shaft member which rotationally drives in a state of being supported by the container body;

a circular cylinder body which is provided coaxially on a radially outer side of the shaft member in such a manner as to surround the shaft member, and rotates about an axial center of the shaft member;

an opening formed in the tubular peripheral wall for allowing the toners to pass through in portions corresponding to opposite end portions in an axial direction of a conveying section; and a conveying section is provided along an axial direction of the shaft member and moves the toners from the opposite end portions in the axial direction of the shaft member toward an axial center portion with rotational driving of the shaft member in the axial direction.

6. The toner container according to claim 5, wherein the circular cylinder body includes:

a semicircular plate-like first frame having a pair of straight plate portions extending in the axial direction and a plurality of semicircular first curved plate portions provided intermittently in the axial direction and extending in a circumferential direction so as to connect the straight plate portions; and a semicircular plate-like second frame having straight plate portions and second curved plate portions which are similar to those of the first frame, wherein the first frame and the second frame are integrated so as to form the circular cylinder body.

7. The toner container according to claim 6, wherein a first engaging portion is provided on one end in an extending direction of the first curved plate portion, and a first engaged portion is provided on the other end, and a second engaged portion which is so shaped as to be engageable with the first engaging portion is provided on one end in an extending direction of the second curved plate portion, and a second engaging portion which is engageable with the first engaged portion is provided on the other end, and an engagement between the first engaging portion and the second engaged portion, and an engagement between the second engaging portion and the first engaged portion forms the circular cylinder body.

8. A toner container which is mounted to an image forming apparatus in a state of containing toners, the toner container comprising:

a container body for containing the toners; and an agitating unit provided in the container body for agitating the toners, wherein the agitating unit includes:

a tubular member having a cylindrically shaped peripheral wall and rotating about an axis of the tubular member;

an opening formed in the peripheral wall for allowing the toners to pass through; and a conveying section for conveying the toners in a direction of the axis of the tubular member, wherein the tubular member includes:

a pair of straight plate portions arranged parallel to the direction of the axis of the tubular member at predetermined intervals; and a plurality semicircular arched pieces provided between the pair of straight plate portions, wherein the arched pieces are arranged at predetermined intervals in the direction of the axis of the tubular member, and the opening is formed between the arched pieces adjacent to each other, and the arched pieces are provided between the pair of straight plate portions in such a manner as to be slanted toward the direction perpendicular to the direction of the axis of the tubular member, so that a function of the conveying section is provided.

9. The toner container according to claim 8, wherein the arched pieces include:

first arched pieces positioned on one side of a plane connecting the pair of straight plate portions; and second arched pieces positioned on the other side, and the first arched pieces and the second arched pieces slant so that the first arched pieces and the second arched pieces substantially form a spiral body.

10. The toner container according to claim 9, wherein conveyance of the toners by the arched pieces move the toners from the opposite end portions of the straight plate portions toward a center portion.

11. The toner container according to claim 8, further comprising: a film member attached to the straight plate portion.

* * * * *